United States Patent [19]

Kleylein

[11] Patent Number: 4,828,261

[45] Date of Patent: May 9, 1989

[54] HANDLE FOR ATHLETIC EQUIPMENT

[76] Inventor: Horst Kleylein, Sudetenstrasse 13, D-8502 Zirnford, Fed. Rep. of Germany

[21] Appl. No.: 89,143

[22] Filed: Aug. 25, 1987

Related U.S. Application Data

[63] Continuation-in-part of Ser. No. 819,889, filed as PCT DE85/00112 on Apr. 11, 1985, published as WO85/04592 on Oct. 24, 1985, abandoned.

[30] Foreign Application Priority Data

Apr. 14, 1984 [DE] Fed. Rep. of Germany ..... 3414293

[51] Int. Cl.[4] ..... A63B 49/08

[52] U.S. Cl. ..... 273/75; 273/735

[58] Field of Search ..... 273/75, 73 J, 81 B

[56] References Cited

U.S. PATENT DOCUMENTS

| | | | |
|---|---|---|---|
| D. 245,443 | 8/1977 | Sweet | 273/75 X |
| 259,448 | 6/1982 | Woodhouse | 273/75 |
| 2,280,382 | 4/1942 | Davis | 273/75 |
| 2,466,502 | 4/1949 | Stiller | 273/75 X |
| 2,523,637 | 9/1950 | Stanfield | 273/75 |
| 2,984,486 | 5/1961 | Jones | 273/75 |
| 4,108,436 | 8/1978 | Masi | 273/75 |

FOREIGN PATENT DOCUMENTS

| | | | |
|---|---|---|---|
| 11615 | 2/1928 | Australia | 273/75 |
| 369272 | 12/1982 | Austria | 273/75 |
| 827602 | 4/1975 | Belgium | 273/75 |
| 2923042 | 12/1980 | Fed. Rep. of Germany | 273/75 |
| 2944982 | 5/1981 | Fed. Rep. of Germany | 273/75 |
| 858205 | 11/1940 | France | 273/75 |
| 2366106 | 7/1976 | France | 273/75 |
| 173914 | 2/1922 | United Kingdom | 273/75 |
| 399072 | 9/1933 | United Kingdom | 273/75 |
| 726149 | 7/1953 | United Kingdom | 273/75 |

*Primary Examiner*—Leonard E. Smith

*Attorney, Agent, or Firm*—Spencer & Frank

[57] ABSTRACT

A handle for athletic equipment comprises a first and second circumferential depressed length portion each formed of two oppositely sloping, curvilinear sides joining at a deepest location of the depressed portion; and a circumferential raised portion flanked by the first and second circumferential depressed portions. The circumferential raised portion has a length of approximately 6–7 cm measured from the deepest location of the first circumferential depressed length portion to the deepest location of the second circumferential depressed length portion. The raised length portion is arranged for supporting a central part of the user's palm encircling the handle, while the first depressed portion is arranged for supporting the edge zone of the user's palm lying in the extension of the little finger and the second depressed portion is arranged for supporting the user's encircling thumb and index finger.

9 Claims, 3 Drawing Sheets

HANDLE FOR ATHLETIC EQUIPMENT

CROSS-REFERENCE TO RELATED APPLICATION

This is a continuation-in-part of application Ser. No. 06/819,889 filed as PCT DE 85/00112 on Apr. 11, 1985, published as WO85/04592 on Oct. 24, 1985, now abandoned.

BACKGROUND OF THE INVENTION

The invention relates to a handle for athletic equipment, such as, for example, tennis rackets, golf clubs, dumbbells or the like. For the sake of simplicity, reference is always made hereinafter to tennis rackets. However, these tennis rackets are intended to be merely representative of all athletic equipment guided by hand in which a manual force is exerted on the equipment.

Present-day tennis rackets or the like are usually brought onto the market with a handle made of wood or plastic which has an octagonal cross section. Such handles permit a secure grip on the racket and additionally permit rotation of the racket during play depending on the direction of play. However, during longer play, these handles have the drawback that they highly stress the gripping hand and thus result in increased perspiration and callus formation. To prevent this, many players are known to wrap the handle with suitable straps, usually leather straps, so as to round its edges and make the surface of the handle more skin friendly.

However, experience with such handles has shown that, although it is possible in this way to realize a certain improvement, the handle leaves much to be desired.

SUMMARY OF THE INVENTION

It is an object of the invention to further develop the known handles for athletic equipment so that the stress on the interior of the striking hand is reduced considerably even during longer periods of play.

This object and others to become apparent as the specification progresses, are accomplished by the invention, according to which, briefly stated, the handle for athletic equipment is, by selection of its material and/or shape, adapted to the anatomical and physiological characteristics of the gripping hand.

In particular, according to the invention, the handle for athletic equipment comprises a first and second circumferential depressed length portion each formed of two oppositely sloping, curvilinear sides joining at a deepest location of the depressed portions; and a circumferential raised portion flanked by the first and second circumferential depressed portions. The circumferential raised portion has a length of approximately 6–7 cm measured from the deepest location of the first circumferential depressed length portion to the deepest location of the second circumferential depressed length portion. The raised length portion is arranged for supporting a central part of the user's palm encircling the handle, while the first depressed portion is arranged for supporting the edge zone of the user's palm lying in the extension of the little finger and the second depressed portion is arranged for supporting the user's encircling thumb and index finger.

In numerous experimental games with differently shaped experimental rackets, the observation was made that the stress on the hand depends to a considerable degree on the type of material of which the handle is made as well as on the shape of the handle. Among a large number of tested materials, a skin-friendly, viscoelastic silicone rubber has given the best results. However, it is also possible to replace this substance by materials having similar characteristics, for example by corresponding types of natural or synthetic rubber.

Further optimum results were attained if the shape of the handle was adapted to the anatomical conditions of the gripping hand in that, in the region where the hand surrounds the grip, the grip was made thicker and this thickened region changes into a supporting recess, at least in the region of the palm edge lying in the extension of the little finger. Preferably, the handle should have an oval cross section.

The above-mentioned thickened region has the result that, during play, the handle lies almost uniformly against all surface regions of the inner hand. The force to be transferred per unit area is thus reduced to the attainable minimum amount. At the same time, however, considerable support is offered to the hand by the mentioned thickened region at the lower edge of the palm. The mentioned shape features bring about the result that with this handle as well, rotation of the racket about its longitudinal axis is possible without any change in the optimum conditions.

In addition to the above-mentioned supporting recess at the lower edge of the palm, one further recess should additionally be provided at the other end of the thickened region to support the index finger as well as the thumb. This further supporting recess is suitable to further stabilize the position of the handle in the hand. However, the first-mentioned supporting groove has greater significance. It is proposed that the thickened region as well as the mentioned supporting recesses surround the entire circumference of the handle. This results in a harmoniously curved handle profile of symmetrical structure.

It has further been found that the gripping characteristics can be improved if the surface of the handle is covered with nubs. In experiments, nubs with rounded ends have been found acceptable. However, nubs having pointed ends or those provided with small suction cups at their ends can also be used. The nubs lightly massage the hand during use of the athletic equipment and simultaneously ideally ventilate the inner hand. The massage increases circulation and suppresses local cramping while the ventilation prevents the formation of a film of perspiration on the inner hand.

The arrangement of nubs on the surface of the handle results in further improvement of the handle in that the handle is covered, in the line forming an extension of either the narrow side or the flat side of the handle, with nubs of a different touch than the remaining nubs. The nubs at the mentioned location may here, for example, be larger or smaller than the other nubs or they may be thicker or harder. In any case, this makes it possible to sense the position of the athletic equipment in the hand, for example a tennis racket, which has considerable advantages during fast play requiring rotation of the racket. In this way, the player is given the opportunity to sense in every phase of play and for every position of the racket the precise orientation of the racket and to correct such position, if necessary.

It is of particular advantage if the proposed handle is in the form of an exchangeable covering made of a material of the above-mentioned type and/or has at least one of the mentioned shape features. The coating may then be pulled over any desired handle portion and may be immobilized by the use of an adhesive. If the coating is worn out, it can be removed and replaced.

In further tests, it was found that the surface of the handle may also be equipped with recessed or raised ridges instead of with nubs. These ridges may be linear or wavy. Such a surface configuration permits effects to be realized as described above in connection with the proposed nubs.

A further possibility has been found which increases the hand-friendliness of handles for athletic equipment. This possibility resides in making the handle and the part of the athletic equipment disposed therebelow permeable to air. This can be accomplished in that the mentioned parts are mechanically perforated or in that (at least the handle) is made of a plastic which can be cast or sintered in a porous form.

DESCRIPTION OF THE PREFERRED EMBODIMENTS

Figure 1:
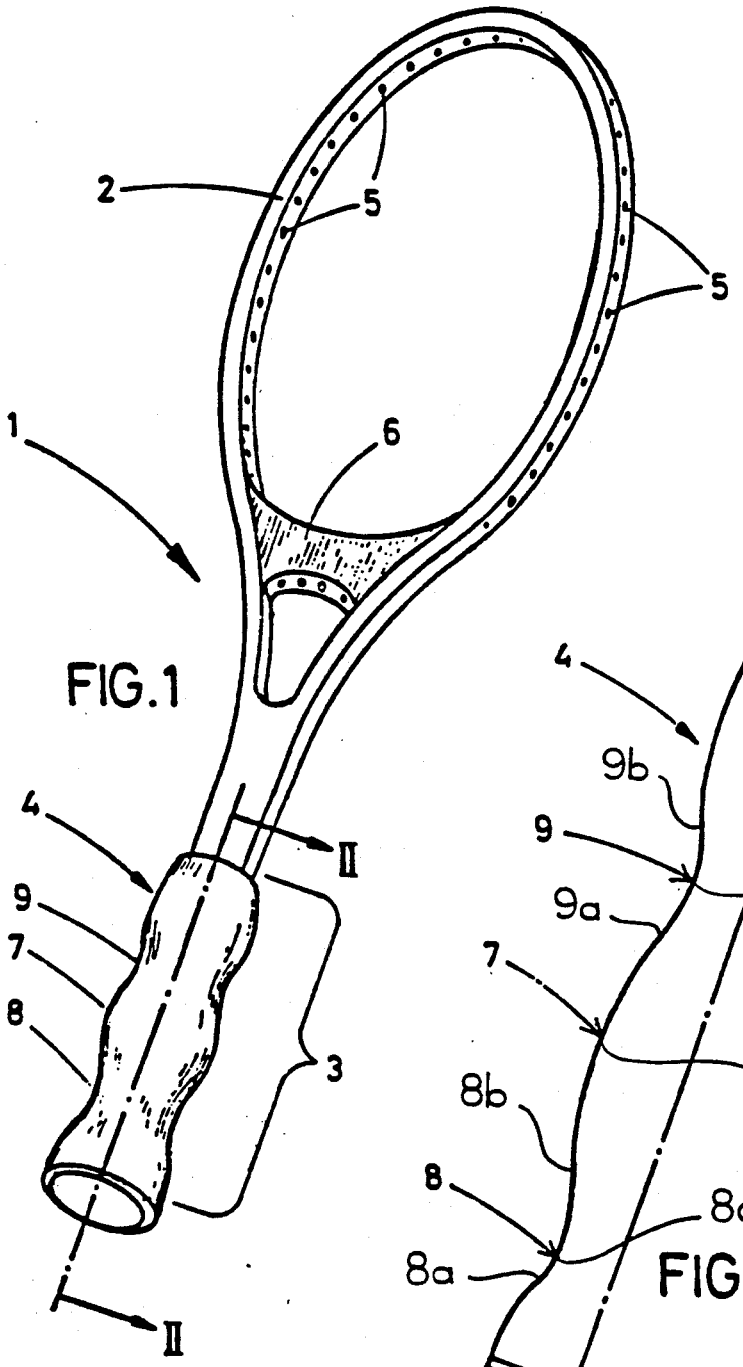
FIG. 1 is a perspective view of a tennis racket having a handle structured according to a preferred embodiment of the invention.

The tennis racket in its entirety as shown in FIG. 1 is designated at 1. It is composed of a frame 2 which at one end changes into the handle member 3. The handle 4 is fastened to handle member 3, for example by shrink fitting to produce a tight fit or by gluing.

The frame 2 may be made, for example, of wood; at present it is usually manufactured of fiber reinforced polyester resin. Numerous holes 5 are worked into the frame and serve to accommodate and hold the strings which are not shown in the drawing.

In the vicinity of the throat, there is disposed a tensioning member 6 which likewise serves to hold the strings.

Figure 2:
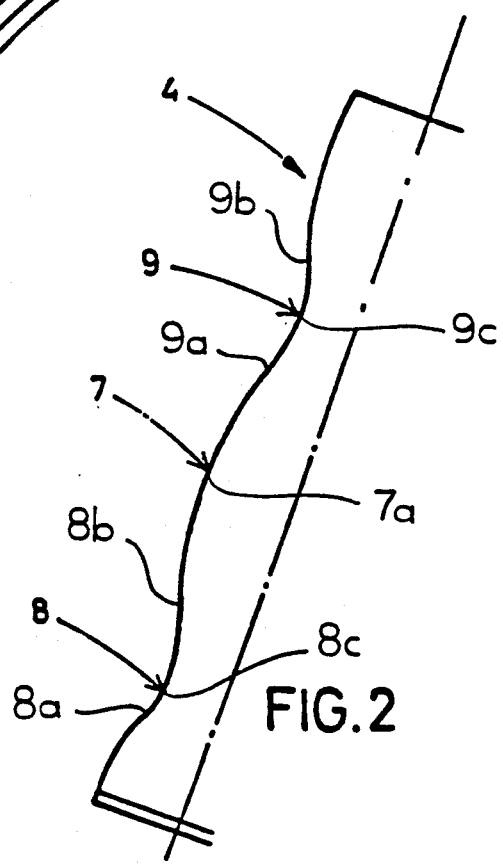
FIG. 2 is a longitudinal sectional view, drawn to scale, of the racket handle, along line II-II of FIG. 1.

Also referring to FIG. 2, the handle 4 has an approximate total length of 12–14 cm and it is of varying thickness along its length. Thus, the handle 4 has two longitudinally spaced depressed portions 8 and 9 between which there is defined a raised length portion 7. The depressed length portions 8, 9 have two oppositely sloping respective curvilinear side walls 8*a*, 8*b* and 9*a*, 9*b* merging at respective deepest locations 8*c* and 9*c*. The raised length portion 7 has a midpoint 7*a* and occupies approximately the center portion of the handle 4 and serves to be gripped by the central part of the user's encircling palm. The length of the raised portion 7 is approximately 6–7 cm long, measured from the deepest location 8*c* of the depression 8 to the deepest location 9*c* of the depression 9. The distance from the location 8*c* of the depression 8 to the adjacent end of the handle 4 is about 2–3 cm while the distance from the location 9*c* of the depression 9 to the adjacent end of the handle 4 is about 3–4 cm. The raised length portion 7 as well as the flanking depressed length portions and 9 have smooth, continuous contour lines from one end of the handle to the other, as may be well observed in FIG. 2. Further, the diameter of the handle 4 measured at the midpoint 7*a* of the raised part 7 is approximately 50% greater than the diameter of the handle 4 measured at the deepest location 8*c* or 9*c* of the depressed portion 8 or 9, respectively.

The above-described particular shape of the handle 4 makes possible to naturally and powerfully grasp the equipment handle 4 with the user's encircling hand: the center portion of the palm is in engagement with the mid length of the raised part 7 whereas the depression 8 provides a support for the palm edge and the little finger whereas the depression 9 provides a support for the encircling thumb and index finger. The handle 4 may be of circular or oval cross section. An oval shape is illustrated in FIG. 1.

Figure 3:
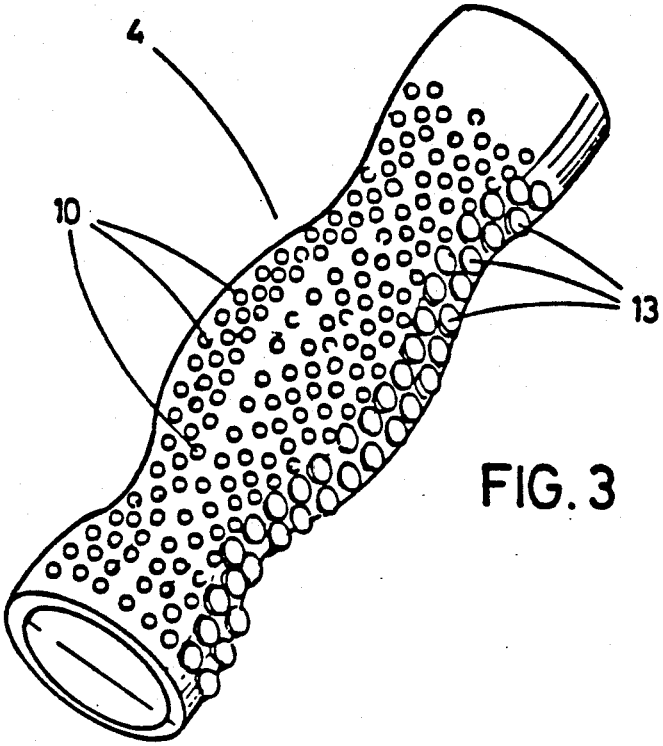
FIG. 3 is a perspective view of another preferred embodiment of the invention.
Figure 4:
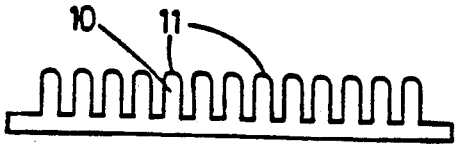
FIGS. 4, 5 and 6 are sectional side elevational views of various surface configurations of the embodiment illustrated in FIG. 3.
Figure 5:
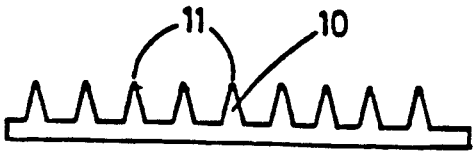
Figure 6:
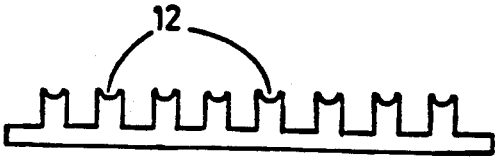

A particularly advantageous embodiment of handle 4 is shown in FIG. 3. There, the handle has the shape of an exchangeable covering which can easily be placed onto the handle end of the racket and may possibly be attached thereto with glue. In this embodiment, the surface of the handle is covered with nubs 10. The nubs have the effect that the inner surface of the gripping hand is massaged lightly and is additionally ventilated. Both effects counteract stress. The nubs provided on the surface of the handle preferably have rounded ends 11 as shown in FIG. 4. However, they may also have pointed ends (FIG. 5) or may be equipped with small suction cups 12 (FIG. 6) at the ends.

It is of particular advantage if the handle, in the extension line of the narrow or flat side of the racket, is equipped with nubs that have a different touch than the remaining nubs. This case is indicated at 13 in FIG. 3. There, the nubs that have a different touch are selected to be larger nubs, namely those whose diameter and height are selected to be larger than those of the remaining nubs. The embodiment has the advantage that these nubs and thus also the side at which they are disposed, can be sensed during play, so that the player is always in control of the position of the racket.

Figure 7:
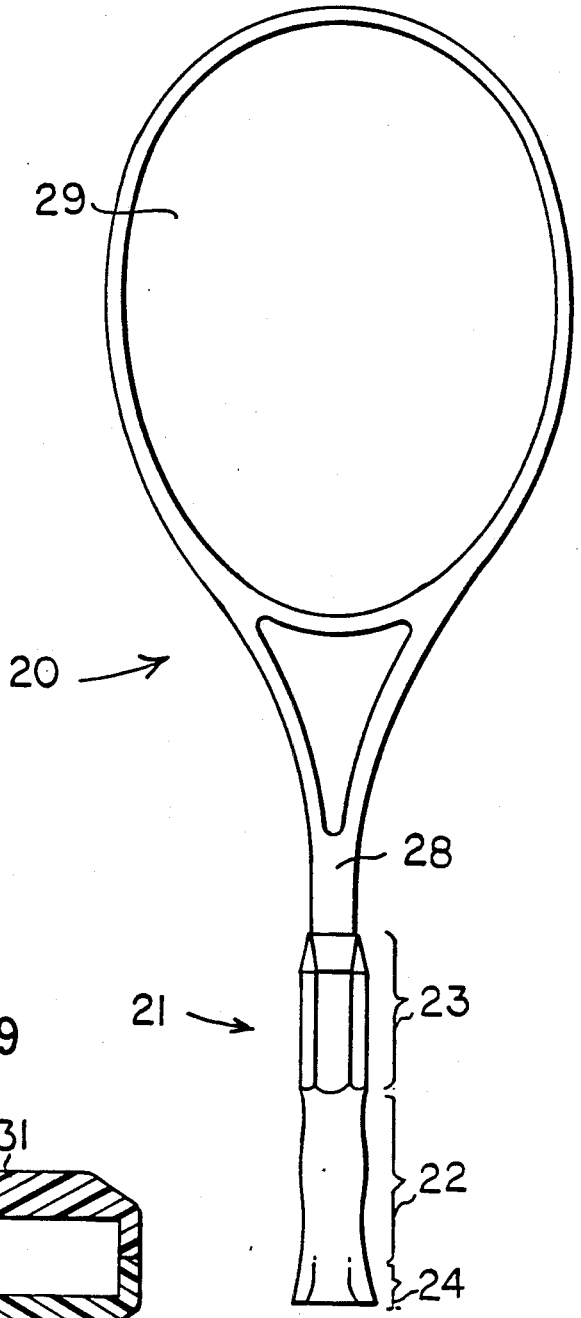
FIG. 7 is a plan view of a tennis racket having a handle structured according to another preferred embodiment of the invention.
Figure 8:
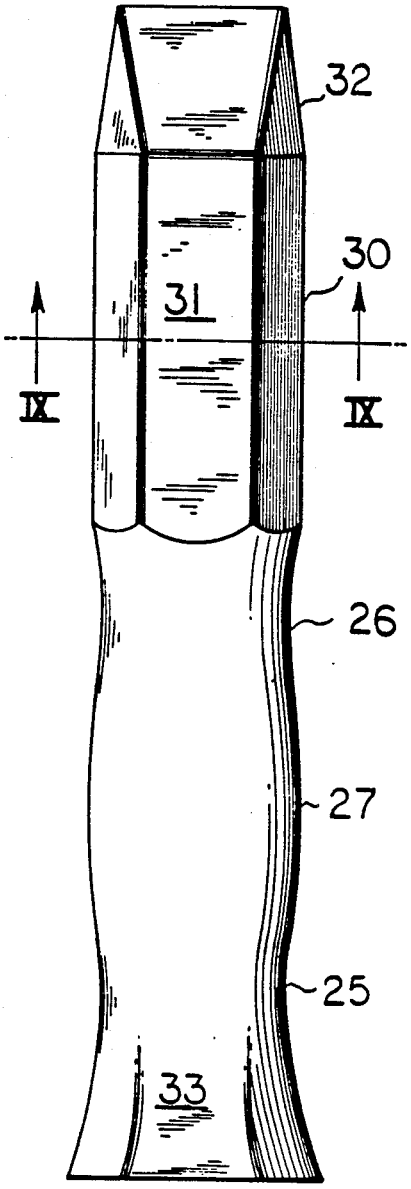
FIG. 8 is a plan view of the handle shown in FIG. 7, drawn to scale.
Figure 9:
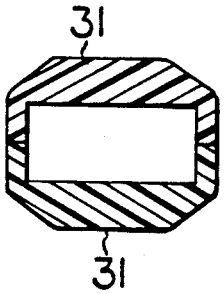
FIG. 9 is a sectional view taken along line IX—IX of FIG. 8.

Turning now to FIGS. 7, 8 and 9, there is illustrated therein a further embodiment of the invention which, in essence, has features in addition to the particularly shaped grip described in connection with FIG. 2.

As seen in FIG. 7, the tennis racket generally designated at 20 has a handle generally designated at 21, divided into a grip portion 22, an upper extension 23 and a lower extension 24, flanking the grip portion 22.

Also referring to FIG. 8, the grip portion 22 is of varying thickness along its length. It has two longitudinally spaced depressed portions 25 and 26 between which there is defined a raised length portion 27. The absolute and relative dimensions of the grip part 22 of varying thickness, its function and advantages correspond to those of the first embodiment described in detail in connection with FIG. 2.

The upper extension 23 of the handle 21 constitutes the connecting part between the grip portion 22 and the racket shaft 28 which, in turn, terminates in the racket head 29. The upper extension 23, at the circumferential zone where it adjoins the upper end of the grip portion 22, is of octagonal configuration, constituting a transition from the generally oval circumference of the grip portion 22. The cross-sectionally octagonal length portion 30 of the extension 23 has two opposite faces 31 which are of identical width and which are markedly wider than the other six, narrower sides of the generally flat octagonal length portion 30, as also illustrated in FIG. 9.

The octagonal length portion 30 changes into an end portion 32 having a rectangular terminal cross section fitting closely around the flat rectangular cross section of the shaft 28.

The unequal width of the various eight faces of the octagonal portion 30 of the upper extension 23 has significant locating functions during play:

As the tennis racket is grasped, the index finger of the player lies on one of the eight faces dependent upon the angular orientation of the racket head 29. Thus, if the first phalanx of the index finger-that is, the finger segment which is closest to the palm-engages one of the wide faces 31, the plane of the head 29 is in a direction parallel to the first phalanx. If, on the other hand, the first phalanx engages one of the narrower faces, for example, one of the faces perpendicular to the faces 31, the player will know, without visual verification that the racket head 29 is turned 90° relative to its earlier described position.

The lower handle extension 24 also has an octagonal configuration as a transition of the curved (oval) shape of the lower part of the grip portion 22. Similarly to the octagonal length portion 30 of the upper extension 23, the lower extension 24 has opposite wide sides 33 which are parallel to the plane of the racket head 29. Since, as the racket is grasped during play, the encircling little finger rests on a wide or on a narrow face of the lower extension 24, an indication of the angular orientation of the racket is given additionally to the cooperation between faces of the upper extension 23 and the player's index finger.

The two octagonal portions 30 and 24 also have a locating function as concerns the longitudinal position of the player's hand relative to the handle 21. Since the faces of the octagonal shapes are formed at opposite ends of the grip portion 22 and constitute certain thickening of the grip, they form between them a zone-namely, the grip portion 22-to which the player's hand is quasi-automatically guided. Thus, the two octagonal portions 24, 30 constitute a further orientational aid for the player as to the precise handle zone which is to be grasped.

It will be understood that the above description of the present invention is susceptible to various modifications, changes and adaptations, and the same are intended to be comprehended within the meaning and range of equivalents of the appended claims.

What is claimed is:

1. A handle for athletic equipment arranged for being encircled and grasped by one hand of the user, comprising a first and second circumferential depressed length portion each formed of two oppositely sloping, curvilinear sides joining at a deepest location of the depressed portion; a circumferential raised portion flanked by said first and second circumferential depressed portions; said raised length portion being arranged for supporting a central part of the user's palm encircling the handle; said first depressed portion being arranged for supporting the edge zone of the user's palm lying in the extension of the little finger and said second depressed portion being arranged for supporting the user's encircling thumb and index finger; said raised length portion, said first depressed length portion and said second depressed length portion being arranged for simultaneously supporting the user's fisted hand; further comprising first and second extensions joining said first and second circumferential depressed length portions and each having a polygonal cross section; two opposite faces of each extension being wider than the other faces of the respective extension, whereby each extension has a cross-sectionally generally flat shape.

2. A handle for athletic equipment as defined in claim 1, wherein said circumferential raised portion has a length of approximately 6–7 cm measured from the deepest location of said first circumferential depressed length portion to the deepest location of said second circumferential depressed length portion.

3. A handle for athletic equipment as defined in claim 1, wherein said first and second extensions have an octagonal cross section.

4. A handle for athletic equipment as defined in claim 1, wherein a diameter of said handle measured in a plane at a midpoint of said raised length portion is about 50% more than a diameter of said handle measured in said plane at either of said deepest locations.

5. A handle for athletic equipment as defined in claim 1, wherein said handle has an oval cross-sectional shape.

6. A handle for athletic equipment as defined in claim 1, wherein the athletic equipment is a tennis racket having a head lying in a main plane; the wider faces of each said extension are planar and are oriented parallel to said main plane.

7. A handle for athletic equipment arranged for being encircled and grasped by one hand of the user, comprising a first and a second circumferential depressed length portion each formed of two oppositely sloping, curvilinear sides joining at a deepest location of the depressed portion; a circumferential raised portion flanked by said first and second circumferential depressed portions; said circumferential raised portion having a length of approximately 6–7 cm measured from the deepest location of said first circumferential depressed length portion to the deepest location of said second circumferential depressed length portion; said raised length portion being arranged for supporting a central part of the user's palm encircling the handle; said first depressed portion being arranged for supporting the edge zone of the user's palm lying in the extension of the little finger and said second depressed portion being arranged for supporting the user's encircling thumb and index finger; said raised length portion, said first depressed length portion and said second depressed length portion being arranged for simultaneously supporting the user's fisted hand; further wherein the length of the handle is approximately 12–14 cm and the distance of the deepest location of the first and second depressed length portions from respective adjacent ends of said handle is 2–3 cm and 3–4 cm, respectively.

8. A handle for athletic equipment as defined in claim 7, wherein a diameter of said handle measured in a plane at a midpoint of said raised length portion is about 50% more than a diameter of said handle measured in said plane at either of said deepest locations.

9. A handle for athletic equipment as defined in claim 7, wherein said handle has an oval cross-sectional shape.

* * * * *